US008540011B2

(12) United States Patent
Wang et al.

(10) Patent No.: US 8,540,011 B2
(45) Date of Patent: Sep. 24, 2013

(54) SHELL-AND-TUBE HEAT EXCHANGER WITH HELICAL BAFFLES

(75) Inventors: Qiuwang Wang, Shaanxi (CN); Qiuyang Chen, Shaanxi (CN); Dongjie Zhang, Shannxi (CN); Min Zeng, Shaanxi (CN); Yining Wu, Shaanxi (CN); Qiang Gao, Shaanxi (CN)

(73) Assignee: Xi'an Jiaotong University (CN)

( * ) Notice: Subject to any disclaimer, the term of this patent is extended or adjusted under 35 U.S.C. 154(b) by 100 days.

(21) Appl. No.: 12/764,702

(22) Filed: Apr. 21, 2010

(65) Prior Publication Data

US 2011/0094720 A1 Apr. 28, 2011

Related U.S. Application Data

(62) Division of application No. 11/966,256, filed on Dec. 28, 2007, now Pat. No. 7,740,057.

(30) Foreign Application Priority Data

Feb. 9, 2007 (CN) ..... 2007 1 0017395
Mar. 9, 2007 (CN) ..... 2007 1 0017478

(51) Int. Cl.
*F28F 9/22* (2006.01)
*F28D 7/16* (2006.01)

(52) U.S. Cl.
USPC ..... 165/145; 165/160; 165/161

(58) Field of Classification Search
USPC ..... 165/145, 156–161
See application file for complete search history.

(56) References Cited

U.S. PATENT DOCUMENTS 948,835 A 2/1910 Walter
1,335,506 A 3/1920 Jones (Continued)

FOREIGN PATENT DOCUMENTS

CN 2310975 3/1999
CN 2387496 7/2000

(Continued)

OTHER PUBLICATIONS

Wang, et al., Prediction of Heat Transfer Rates for Shell-and-Tube Heat Exchangers by Artificial Neural Networks Approach, International Journal of Thermal and Fluid Sciences, 2006, 7 pages, vol. 15, No. 3, Science Press, Bejing.

(Continued)

*Primary Examiner* — Leonard R Leo
(74) *Attorney, Agent, or Firm* — Hanley, Flight & Zimmerman, LLC

(57) ABSTRACT

The present invention provides a single shell-pass shell-and-tube heat exchanger with helical baffles, where within a single pitch, the helical baffles are separated into inner and outer parts along the radial direction of the shell. In the central portion of the inner space of the shell, an inner non-continuous helical form is employed; in other portion outside the central portion, doughnut shaped helical baffles with continuous curved surfaces are arranged to form an outer continuous helical baffle, and the outer helical baffles are arranged to surround the inner helical baffles. Furthermore, the present invention relates to a multiple shell-pass shell-and-tube heat exchanger with helical baffles, in which complete continuous helical baffles are provided in shell-sides other than the inner shell-pass, while non-continuous helical baffles or other flow guide means are employed in the inner shell-pass. The present invention makes flow patterns of fluids on the shell side more desirable, leading to a reduced flow pressure drop, and mitigate fouling, thus the heat transfer rate is improved and the service life of the heat exchanger is increased. The present invention also provides two methods for manufacture of continuous helical baffles, which ensure the concentricity of the tube bundle holes on each continuous helical baffle so as to facilitate installation of heat exchange tube bundles.

6 Claims, 10 Drawing Sheets

(56) References Cited

U.S. PATENT DOCUMENTS

| | | | | | |
|---|---|---|---|---|---|
| 1,454,053 | A | | 5/1923 | Jones | |
| 1,522,866 | A | | 1/1925 | Colston | |
| 1,524,595 | A | | 1/1925 | Sward | |
| 1,525,094 | A | | 2/1925 | Jones | |
| 1,782,409 | A | | 11/1930 | Chute | |
| 1,790,151 | A | * | 1/1931 | How | 165/160 |
| 1,798,354 | A | | 3/1931 | Ris | |
| 1,853,236 | A | | 4/1932 | Shadle | |
| 2,384,714 | A | | 9/1945 | Villiger | |
| 2,591,658 | A | | 4/1952 | Haringhuizen | |
| 2,693,942 | A | | 11/1954 | Guala | |
| 2,774,575 | A | * | 12/1956 | Walter | 165/160 |
| 2,937,079 | A | | 5/1960 | Pool | |
| 3,400,758 | A | | 9/1968 | Lee | |
| 3,848,430 | A | | 11/1974 | Porter et al. | |
| 3,961,665 | A | | 6/1976 | Langbroek et al. | |
| 4,360,059 | A | | 11/1982 | Funke | |
| 5,217,066 | A | | 6/1993 | Killebrew | |
| 5,915,465 | A | * | 6/1999 | Fix et al. | 165/159 |
| 6,513,583 | B1 | | 2/2003 | Hughes | |
| 6,719,041 | B2 | * | 4/2004 | Docter et al. | 165/159 |
| 6,827,138 | B1 | | 12/2004 | Master et al. | |

FOREIGN PATENT DOCUMENTS

| | | |
|---|---|---|
| CN | 2489296 | 5/2002 |
| CN | 1529113 | 9/2004 |
| CN | 2655156 | 11/2004 |
| CN | 2745017 | 12/2005 |
| CN | 1719187 | 1/2006 |
| CN | 1821700 | 8/2006 |
| CN | 1821700 A | 8/2006 |
| CN | 200710017478.5 | 11/2008 |
| CN | 200710017395.6 | 1/2009 |
| DE | 102005010261 | 9/2006 |
| JP | 56077690 | 6/1981 |
| JP | 58217192 | 12/1983 |
| JP | 59012294 | 1/1984 |
| JP | 59173695 | 10/1984 |
| WO | 2005043061 | 5/2005 |

OTHER PUBLICATIONS

G.N. Xie et al., Heat transfer analysis for shell-and-tube heat exchangers with experimental data by artificial neural networks approach, Applied Thermal Engineering 27, 2007, pp. 1096-1104 (9 pages), Elsevier.

Wang, et al., Experimental Study and Genetic-Algorithm-Based Correlation on Shell-Side Heat Transfer and Flow Performance of Three Different Types of Shell-and-Tube Heat Exchangers, Journal of Heat Transfer, Sep. 2007, vol. 129, pp. 1277-1285 (9 pages).

English Translation of First Notification of Office Action, issued by the State Intellectual Property Office of China in connection with application No. 2007100173956, on Apr. 4, 2008, 4 pages.

First Notification of Office Action, issued by the State Intellectual Property Office of China in connection with application No. 2007100173956, on Apr. 4, 2008, 4 pages.

English Translation of 2nd Notification of Office Action, issued by the State Intellectual Property Office of China in connection with application No. 2007100173956, on May 30, 2008, 3 pages.

2nd Notification of Office Action, issued by the State Intellectual Property Office of China in connection with application No. 2007100173956, on May 30, 2008, 3 pages.

English Translation of First Notification of Office Action issued by the State Intellectual Property Office of China in connection with application No. 2007100174785, May 30, 2008, 3 pages.

First Notification of Office Action issued by the State Intellectual Property Office of China in connection with application No. 2007100174785, May 30, 2008, 3 pages.

* cited by examiner

SHELL-AND-TUBE HEAT EXCHANGER WITH HELICAL BAFFLES

CROSS REFERENCE TO RELATED APPLICATIONS

This patent application is also a divisional of U.S. patent application Ser. No. 11/966,256, filed on Dec. 28, 2007, the entire content of which is hereby expressly incorporated by reference. This patent application claims priority to Chinese patent application no. 200710017395.6, filed on Feb. 9, 2007, and Chinese patent application no. 200710017478.5, filed on Mar. 9, 2007.

FIELD OF THE INVENTION

The present invention relates to a shell-and-tube heat exchanger used in petrochemical industry, energy power industry, metallurgical industry, refrigeration engineering and seawater desalination, especially to a single shell-pass shell-and-tube heat exchanger with helical baffles and a multiple shell-pass shell-and-tube heat exchanger with helical baffles, and also relates to a manufacture method for outer helical baffles of a shell-and-tube heat exchanger with helical baffles.

BACKGROUND OF THE INVENTION

Among others, heat exchangers are important apparatuses that are widely used in petrochemical industry, energy power industry, metallurgical industry, refrigeration engineering and seawater desalination. Among heat exchange equipments, the shell-and-tube heat exchangers are predominant, accounting for about 55-70%. This type of heat exchanger has a simple structure that mainly contains two parts, i.e., heat exchange tube bundles and shells. When one kind of fluid flows inside the tubes, and the other kind of fluid flows outside the tubes against the shell side, the two fluids indirectly exchange heat through the tube wall.

In a shell-and-tube heat exchanger, a more important function of the baffles, besides supporting the tube bundles, is to change the flow direction of fluid in the shell-sides so as to enhance heat transfer rate.

There exist many problems in the conventional segmental baffles, e.g., (1) a high pressure drop occurs since the segmental baffles make fluid perpendicularly impact the shell wall and the tubes, leading to an increased power load; (2) the fluid with high speed crosses the heat exchange bundles laterally, inducing vibrations of heat exchange tubes and thus a reduced service life; (3) the heat transfer rates decrease due to a flow stagnation region generated at the joint of baffles and shell walls, where fouling tends to accumulate as well; and (4) the mass flow rate laterally crossing tube bundles is efficiently decreased due to the bypass flows and leaking flows which exist between baffles and shell walls and between heat exchange tubes and baffles, resulting in a reduced heat transfer rate on the shell side.

Aimed at the above problems, some new kinds of shell-and-tube heat exchangers with helical baffles are developed in recent years. In these newly developed heat exchangers, baffles are arranged in helix to make the fluid on the shell side of the heat exchanger flow along a helical path, resulting in an affirmative reduction in flow pressure drop on the shell side and an enhancement in heat transfer rate. Heat exchangers with helical baffles in the prior art may be classified into two categories, one being heat exchangers with non-continuous helical baffles employing non-continuous helical baffles formed of a plurality of fan or oval shaped flat plates, with the non-continuous helical baffles in a continuously overlap form (see CN Patent Application No. 99241930.1 and U.S. Pat. No. 6,827,138 B1,) or in a staggered helical form (see CN Patent Application No. 200320106763.1); the other being heat exchangers with continuous helical baffles employing continuous helix (see CN Patent Application No. 200510043033.5). As compared with non-continuous helical baffles, the continuous helical baffles make the flow assume a helical pattern, which further reduces pressure drop and leakage. However its manufacture is more complicated than in the case of non-continuous helical baffles. This is especially the case when the pitch is large, that is, the helical surface becomes relatively steep in portions close to the central axis, which makes it more difficult, or even impossible to manufacture curved surfaces and to position and form holes on these surfaces. Currently, in order to make it easier for fluid on the shell side to accomplish helical flow patterns, most of shell-and-tube heat exchangers with continuous helical baffles are additionally installed with a central tube of a certain diameter along the centre axis. This somehow mitigates the difficulty in the manufacture of continuous helical baffles, however, it relatively decreases the efficient heat exchange area of heat exchangers since no fluid passes through the central tube, and the diameter of the central tube increases with the increase of baffle pitch.

Moreover, some researches show that, given same tube-side arrangements and same shell-side flow rate, the current single shell-pass heat exchanger with helical baffles has higher heat exchange capacity under the same shell-side pressure drop. While its pressure loss is lower than that of a traditional heat exchanger with segmental baffles, however, its heat exchange capacity is also lower, simultaneously which can hardly meet users' requirement. To enhance shell side heat transfer rate, a multiple shell-pass shell-and-tube heat exchanger with continuous helical baffles was proposed (see CN Patent Application No. 200610041949.1, which corresponds to Publication No. CN1821700A). Given same number of tube-side and same flow rate, the velocity of fluid in a shell-side in a multiple shell-pass shell-and-tube heat exchanger is higher than that in a single shell-pass shell-and-tube heat exchanger. Therefore the heat exchange coefficient becomes higher, that is, a higher heat transfer rate is achieved.

A non-continuous helical baffle is formed by splicing a plurality of fan shaped or oval shaped flat plates. This has an advantage that manufacture is easy. Generally, a central pole is employed for positioning the center and the volume occupied by the central pole is small. However, there is a relatively large leakage, which affects heat exchange. Continuous helical baffles are formed by splicing complete continuous helical baffles of many cycles, each cycle being a continuous helical curved plate, such that the flow behavior approximates to a helical pattern. This has an advantage that pressure drop and leakage are reduced and heat transfer coefficient is higher, however, when the pitch is large, the helical surface becomes relatively steep at portions close to the central axis, where it is difficult to manufacture the continuous helical surfaces. Generally, a central tube is employed to fit the helical structure inside of the helix. However, as heat exchange tubes can not be arranged at the location of the central tube, the effective heat exchange area of the heat exchanger is relatively decreased, and part of the heat exchanger volume is occupied, thus leading to a decreased compactness. Currently, there is no heat exchanger with helical baffles having the advantages of both continuous helical baffles and non-continuous helical baffles.

Further, the shell-and-tube heat exchangers used in industries are generally in form of a horizontal type. The continuous helical baffles may reduce leakage, however when the fluid on the shell side is such a medium that tends to foul, fouling can accumulate at the bottom of the horizontally arranged shell-and-tube heat exchanger due to a low flow rate. Especially when the helical angle is small, a large amount of fouling will deposit and cleanup becomes difficult, thus resulting in a decreased heat transfer rates.

SUMMARY OF THE INVENTION

To overcome the above defects, one fundamental object of the present invention is to provide a shell-and-tube heat exchanger with helical baffles, its structure being such that the fluid flow in the shell-sides is in a more desirable pattern, the flow pressure drop is decreased and the heat transfer rates are increased. Meanwhile, the structure of the shell-and-tube heat exchanger with helical baffles according to the present invention renders the configuration of baffles at the portion next to the central axis more desirable when the pitch is large, which facilitates fluid flow and heat exchanging and makes manufacture thereof easier.

In addition, the present invention provides manufacture methods for outer helical baffles of the shell-and-tube heat exchanger with helical baffles. Such methods may overcome the problem that it is difficult to manufacture the curve of continuous helical baffles and to position and form holes.

According to the object of this invention, in the first aspect of the invention, there is provided a single shell-pass shell-and-tube heat exchanger with helical baffles, comprising, a shell body, an inlet tube on the shell side, an outlet tube on the shell side, heat exchange tube bundles, tube plates, and helical baffles provided to the tube bundles, wherein said helical baffles comprise a plurality of inner helical baffles and a plurality of outer helical baffles, and the heat exchange tube bundles penetrate through the inner helical baffles and the outer helical baffles, and are arranged to the two tube plates on both ends of the shell body; within each pitch, the inner helical baffles are placed in the central region in the space inside the shell body, the outer helical baffles are placed around the inner helical baffles, at the joint of the inner helical baffles and the outer helical baffle, edges of the inner helical baffles and the outer helical baffles are penetrated through by a same bundle of heat exchange tubes, the outer edge of each inner helical baffle is proximally joined to the outer helical baffle; and said outer helical baffle is form by splicing a plurality of helical baffles in such a transition manner that the plate surfaces of individual baffles are continuous to each other along the helical direction, so the outer helical baffle has a plurality of helical cycles and takes the form of a helical baffle with plate surfaces thereof completely continuous, while the inner helical baffles are a plurality of non-continuous baffles; and the inlet tube on the shell side and the outlet tube on the shell side on said shell body take the form that fluids are introduced into and discharged out laterally, are closely attached to the outer edge of the shell body, and lead to and from the shell side space in the tangential direction to the shell body.

Thus, through such an appropriate arrangement of the inner and outer helical baffles, while both the inner and outer helical baffles baffle the flow consistently, smoothly and gently, and direct flow in a helical fashion so as to increase heat transfer rate and decrease pressure drop and impact vibrations, the outer helical baffle becomes easier to manufacture due to its relatively large diameter of inner edge. Even under the circumstance that the pitch is large, a heat exchanger having the above mentioned advantages can still be manufactured, because the baffles are designed as separate inner helical baffles and outer helical baffles such that it remains easy to manufacture and install the inner baffles.

That is, in order to make it easier to form helical flows in the shell, the present invention utilizes combined helical baffles, where continuous helical baffles are used in most part of the inner space of the shell, and non-continuous helical baffles are used in the central region where it is difficult to process and install continuous helical baffles, thus avoiding space waste on the shell side and the tube side which may be otherwise caused by installing central tubes.

Moreover, the way of installing the inlet tube on the shell side and the outlet tube on the shell side in the tangential direction to the helical circumference further decreases flow pressure drop and improves flow behavior. That is, they are conformably attached to the outer edge of the shell, and lead to and from the space on the shell side along tangential direction to the shell body, such that the flow on the shell side resembles helical flow to the extend that the flow field is more fluent, and the local pressure drop caused by inlet and outlet is decreased.

In the above mentioned heat exchangers provided by the present invention, within each pitch, the inner helical baffle may be formed by splicing a plurality of fan or oval shaped flat plates with each other, while in each pitch the outer helical baffle may be a one-piece continuous helical curved plate.

In this simple way, under the circumstances of more than two pitches, the inner baffle can be kept in a substantial same helical pattern as the outer helical baffles, such that the inner helical baffles essentially maintain a pattern of helical plates, without affecting the overall helical flow pattern to a significant extent. At the same time it is easier to manufacture such heat exchangers.

According to the object of this invention, in the second aspect of the invention, there is provided a multiple shell-pass shell-and-tube heat exchanger with helical baffles, comprising a shell body, an inlet for heat exchange tube bundles and an outlet for heat exchange tube bundles provided at end(s) of the shell body, heat exchange tube bundles penetrating through helical baffles and connected to two tube plates on each end of the shell body, a first inner sleeve tube coaxially provided in the shell body, a second inner sleeve tube provided outside the first inner sleeve tube, an end of the second inner sleeve tube connected to the tube plate, the first inner sleeve tube provided with a separating plate at the opposite end to the end at which the second inner sleeve tube is connected to the tube plate, whereby there form an outer shell-pass between the shell body and the second inner sleeve tube, a middle shell-pass between the first inner sleeve tube and the second inner sleeve tube and an inner shell-pass in the first inner sleeve tube; an outer shell-pass inlet tube and an inner shell-pass outlet tube provided to the shell body, whereby there forms a shell-side flow passage outside said tube bundles, wherein baffles in shell-sides other than the inner shell-pass are formed by splicing a plurality of helical baffles in such a transition manner that the plate surfaces of individual baffles are continuous to each other along the helical direction, so said baffles in shell-sides other than the inner shell-pass have a plurality of helical cycles and take the form of helical baffles with plate surfaces thereof completely continuous, while the inner shell-pass is provided with a plurality of non-continuous baffles.

According to the second aspect of the present invention, improvements to the shell side of a multiple shell-pass shell-and-tube heat exchanger with helical baffles are proposed. As for a shell-and-tube heat exchanger with triple shell-pass helical baffles, baffles in the outer and middle shell-pass are formed by splicing a plurality of complete continuous helical baffles with multiple cycles, each cycle being a continuous helical curved plate, while baffles in the inner shell-pass are a plurality of non-continuous baffles. This heat exchanger employs complete continuous helical baffles in a shell region to form a helical flow, which reduces leakage, vibrations and pressure loss; at the same time, difficulty of manufacturing helical surface in the portion of smaller diameter is avoided, instead, non-continuous baffles are installed in the inner shell-pass. Non-continuous baffles of the inner shell-pass may employ non-continuous helical baffles, or segmental baffles, or circular disk-doughnut baffles, or baffle rods, or multi-hole circular baffles. This has an advantage that the complete continuous helical baffles could have a relatively large diameter at the inner edge, which makes manufacture more convenient. There is no need to install a central tube, in this way heat exchange space in the shell-side of heat exchanger is saved up, therefore more heat exchange tubes may be installed to improve compactness of the heat exchanger. When the flow rate is small in the shell-sides of the heat exchanger, the inner sleeve tube of the inner shell-pass has a small diameter and the inner shell-pass is short, only heat exchanging tubes and no baffles are installed in the inner shell-pass, thus fluid flows in parallel to the heat exchanging tubes. This simplifies manufacture process of the inner shell-pass.

Preferably, the main bodies of said baffles in shell-sides other than inner shell-pass are formed by splicing a plurality of one-piece helical curved plate units, each of which constitutes a helical cycle.

That is, the multiple shell-pass shell-and-tube heat exchanger with helical baffles according to the invention utilizes complete continuous helical baffles in the outer shell-pass and the middle shell-pass, and utilizes non-continuous baffles in inner helix, which not only enables fluids in the outer and middle shell-pass to flow almost in a helical pattern to reduce flow pressure drop and leakage, but also sufficiently take advantage of the space in the inner shell-pass, thus making manufacture easier, rendering the structure of the heat exchanger more compact and also enhancing heat transfer rate.

According to the multiple shell-pass shell-and-tube heat exchanger with helical baffles of the present invention, non-continuous baffles of the inner shell-pass can be non-continuous helical baffles, or segmental baffles, or circular disk-doughnut baffles, or baffle rods, or multi-hole circular baffles.

The arrangement of employing various forms of non-continuous baffles for the inner shell-pass is favorable for manufacturing helical baffles of the outer and middle shell-passes as a continuous helical form, and especially when the pitch of the helical baffles of the outer and middle shell-passes are large or their diameters are large, is in favor of ensuring formation of helical baffles in the outer and middle shell-passes. Moreover, the degree of freedom in designing the multiple shell-pass heat exchangers with helical baffles is increased as well.

Certainly, the inner shell-pass is formed by splicing a plurality of fan shaped or oval shaped flat plates with each other, thus maintaining the inner helical baffles substantially in the shape of helical plates. This is more desirable for helical fluid flows in that heat exchange efficiency is increased.

As a variant solutions in the multiple shell-pass shell-and-tube heat exchanger with helical baffles according to the invention, it forms a heat exchanger of dual shell-sides when there is only one inner sleeve tube in said heat exchanger; and it forms a heat exchanger of multiple shell-pass when there are a first inner sleeve tube and a second inner sleeve tube or even more inner sleeve tubes.

Diameters of individual inner sleeve tubes should be determined in such a way to ensure that open areas in section of individual shell-sides are more or less the same, and that the flow rates in individual shell-sides are equivalent. For shell-and-tube heat exchangers with very high demand of heat exchange and large number of tube-sides, a helical shell-and-tube heat exchanger configured in a multiple shell structure can be employed to enhance heat transfer coefficient and reduce cost of heat exchanging equipments.

Furthermore, the flow directions in the outer shell-pass inlet tube and inner shell-pass outlet tube can be swapped, thus respectively becoming outer shell-pass outlet tube and inner shell-pass inlet tube accordingly.

When the temperature difference between the inlet fluid on the shell side and the environment is smaller than the temperature difference between the outlet fluid on the shell side and the environment, the inlet fluid on the shell side may be first directed through the outer shell-pass, and then through the inner shell-pass, and eventually be discharged out of the shell body; when the temperature difference between the inlet fluid on the shell side and the environment is larger than the temperature difference between the outlet fluid on the shell side and the environment, the inlet fluid on the shell side may first directed through the inner shell-pass, and then through the outer shell-pass, and eventually be discharged out of the shell body. This features in flexibility in choosing flow modes as required by operative process, and ensures the temperature difference between the outer shell-pass fluid and the environment to be smaller than the temperature difference between the inner shell-pass fluid and the environment, thus reducing cost for insulating materials.

Moreover, the said non-continuous helical baffles of the inner shell-pass may be of helical baffles in a splicing form, or helical baffles in a staggered form.

Said helical baffles may take forms of single helix or multiple helix as according to requirements from process and technical design. Also, the structure of the helical baffles in the shell can be left-handed helix or right-handed helix as required by installation and design.

In the apparatus in the first and second aspects of the invention, when said single shell-pass shell-and-tube heat exchanger with helical baffles is of a horizontal type, the outer helical edge of each piece of helical baffle may be provided with anti-fouling openings at the positions closest to the ground. Alternatively, when said multiple shell-pass shell-and-tube heat exchanger with helical baffles is of a horizontal type, the outer helical edges of said helical baffles in shell-sides other than the inner shell-pass are provided with anti-fouling openings at the positions closest to the ground.

To be more specific, a gap may be cut out at the spliced portion of the edge of the outer helix of each outer helical baffle, such that an anti-fouling opening is formed at the splicing portion when adjacent outer helical baffles are spliced together. Those anti-fouling openings are located at the bottom of the horizontal type heat exchanger where fouling tends to accumulate. In this way, part of fluid is allowed to flow therethrough, the dead areas are reduced and fouling accumulated on the shell side is removed, thus preventing a large amount of fouling from depositing, which would otherwise affects heat transfer rate of tubes at the bottom of the heat exchanger.

Further, the complete continuous helical baffles of a shell-and-tube heat exchanger, which is installed in a horizontal form, are provided with anti-fouling openings at the positions near the bottom of the shell body.

This is particularly desirable for large fouling of shell-and-tube heat exchangers, since generally they are horizontally installed, that is, the axis is parallel to the ground, such that fouling in the fluid on the shell side tends to accumulate at the bottom of the heat exchanger, making it hard to be removed. This situation becomes more serious especially under the circumstances when flow rate is low, therefore an anti-fouling opening may be provided at the spliced portion of each cycle of two adjacent complete continuous helical baffles, next to the edge of the outer helix. The shape of the anti-fouling opening may be form into a triangle region, a fan-shaped region, an arch-shaped region or a rectangular region according to operative process. On the arc side of the segmental baffle, a triangle region, a fan-shaped region or a rectangular region may also be cut out to form an anti-fouling opening. The anti-fouling openings are normally located at the bottom of the shell sides of the heat exchanger. This can prevent a large amount of fouling from accumulating at the bottom of the heat exchanger, such that anti-fouling ability of the heat exchanger on itself is increased, the heat exchanger is guaranteed to have a stable heat transfer rate, the cleaning interval is prolonged, the cleaning cost is lowered, leading to a longer service life of the apparatus and a smooth operation.

In situations where working mediums of shell-side fluids are relatively clean, it is not necessary to provide heat exchangers with such anti-fouling openings.

According to the third aspect of the present invention, the invention provides a manufacture method for outer helical baffles of a shell-and-tube heat exchanger with helical baffles, wherein, a plurality of blank plates of outer helical baffles are stacked up, positioning holes of smaller diameters than those of tube bundle holes are formed at individual positioned centers on the blank plates of outer helical baffles, then the blank plates of the outer helical baffles are stretched one by one, and the tube bundle holes are formed according to the positioning holes so as to form outer helical baffles. This method is particularly suitable to the manufacture of baffles made of rigid materials such as metals and installation thereof.

According to the fourth aspect of the present invention, the invention further provides a manufacture method for outer helical baffles of a shell-and-tube heat exchanger with helical baffles, wherein, a plurality of blank plates of outer helical baffles are stacked up, tube bundle holes are directly formed at individual positioned centers on the blank plates of outer helical baffles, then the plates of the outer helical baffles are stretched one by one so as to form outer helical baffles. This method is particularly suitable to the manufacture and installation of baffles made of soft materials such as plastic.

To accurately manufacture continuous helical baffles efficiently, the present invention provides two methods for manufacturing the continuous helical baffles. These two methods ensure the concentricity of the tube bundle holes on each continuous helical baffle and allow holes on the stretched continuous helical baffles to be accurately formed, to the effect that installation is facilitated.

In conclusion, the present invention at least possesses the following advantages that:

Pressure loss may be reduced;

Manufacture process may be simplified;

Compactness and heat transfer rate of the heat exchanger may be improved;

Anti-fouling ability of the heat exchanger on itself may be improved, the cleaning interval may be prolonged, the cleaning cost may be lowered, and the number of interruption for cleaning may be reduced, leading to a longer service life and a smooth operation.

DETAILED DESCRIPTION OF THE INVENTION

Hereinafter, detailed explanations will be given to the present invention with references to the drawings.

Figure 1:
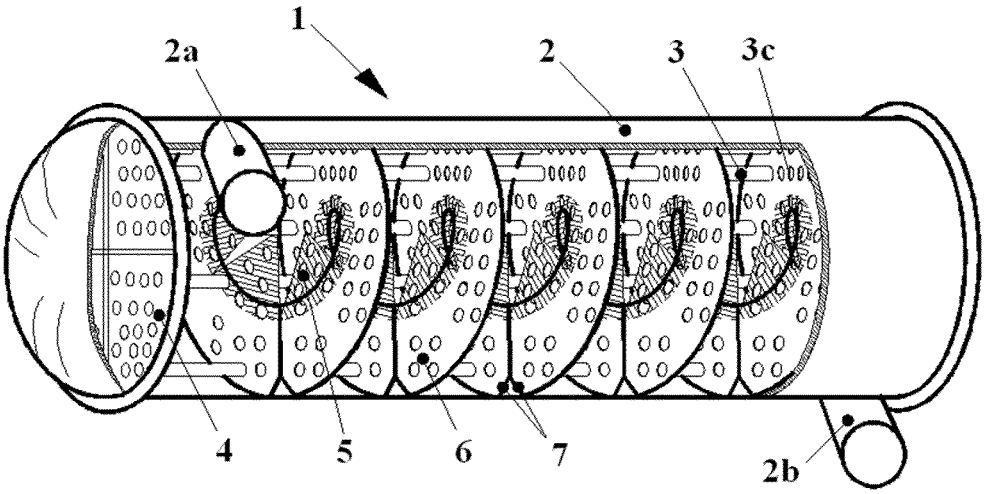
FIG. 1 is a schematic view of a single shell-pass shell-and-tube heat exchanger with helical baffles according to the present invention.

As shown in FIG. 1, the shell-and-tube heat exchanger with combined helical baffles according to present invention comprises a shell body 2, a shell side inlet tube 2*a*, a shell side outlet tube 2*b*, a heat exchange tube bundle 3, tube plates 4, inner helical baffles 5, and outer helical baffles 6. The inlet tube on the shell side 2*a* and the outlet tube on the shell side 2*b* of the shell body 2 take the form that fluids are introduced into and discharged out laterally. They are mounted to the shell body 2, in close proximity to its outer periphery. Fluid is introduced into and discharged out along the directions tangent to the shell body, such that the behavior of the fluid on the shell side becomes more similar to helical flows and the local pressure drop at the inlet and the outlet are reduced. The heat exchange tube bundle 3 penetrates through the inner and out helical baffles 5 and 6, and the two tube plates 4 on both ends of the shell body. Within each pitch, the inner helical baffle 5 is placed at the central portion of the inner space of the shell body 2, and the outer helical baffle 6 is arranged around the inner helical baffle 5. At the joint thereof, their edges are penetrated by the same heat exchange tube bundle 3, the outer edge of each inner helical baffle 5 is closely installed to the outer helical baffle 5. To install the heat exchange tube bundle 3, tube bundle holes 3*c* are provided on both the inner helical baffles 5 and outer helical baffles 6. If the fluid on the shell side tends to foul, an anti-fouling opening 7 can be cut out at the joint of adjacent outer helical baffles 6 to mitigate fouling.

Figure 2:
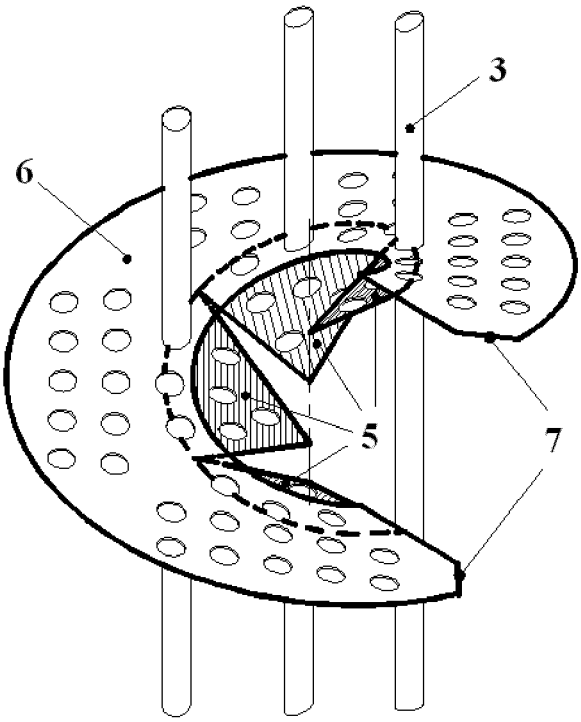
FIG. 2 is a schematic view of inner and outer helical baffles according to the present invention.

FIG. 2 is a schematic view of combined inner and outer helical baffles. Within each single pitch, helical baffles are separated into two parts, i.e., an inner part and an outer part. The inner helical baffle 5 is formed by a plurality of oval or fan-shaped plates spliced at a certain angle relative to the axis, while the outer helical baffle 6 is a piece of continuous curved plate in a doughnut shape. The inner and outer helical baffles make the fluid on the shell side flow in helix manner to enhance heat exchange. Although the figure exemplifies that the inner helical baffles 5 is formed of four fan-shaped plates, the number of fan-shaped plates can be 2, 3, 5 . . . (preferably plates take an oval shape when the number is 2). In order to relatively closely splice the inner helical baffles 5 and the continuously curved outer helical baffle 6 so as to reduce leakage, the inner helical baffles 5 should be proximally joined to the outer helical baffle 6, and, together with the outer helical baffle 6, be penetrated by a same heat exchange tube bundle 3.

Figure 3:
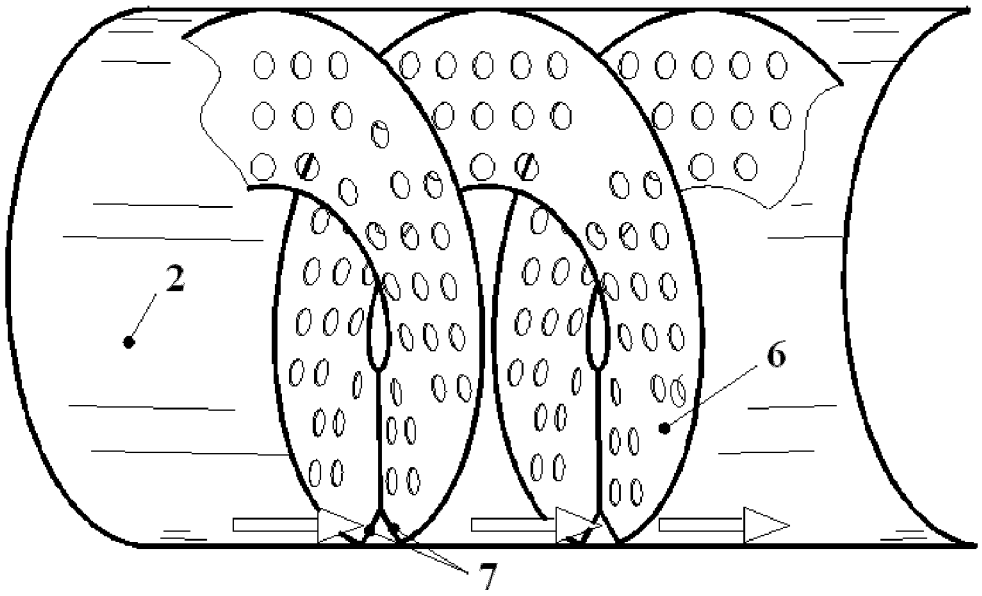
FIG. 3 is a schematic view of the joint of outer helical baffles according to the present invention.

As shown in FIG. 3, the form of the outer helical baffles can be modified to solve the problem of fouling accumulation. A gap may be cut out at the spliced portion of the edge of the outer helix of each outer helical baffle 6, such that an anti-fouling opening 7 as shown in figures is formed. In this way, when two adjacent outer helical baffles are spliced with each other, a gap will be formed at the anti-fouling openings 7 at the spliced portion or at the joint of two adjacent helical baffles. In FIG. 3, the anti-fouling opening is located at the bottom of the horizontal type heat exchanger where fouling tends to accumulate. Therefore, part of fluid is allowed to flow therethrough, the dead area is reduced and fouling deposited on the shell side is removed, thus preventing a large amount of fouling from depositing, which would otherwise affects heat transfer rate of tubes at the bottom of the heat exchanger. In situations where working mediums of shell-side fluids are relatively clean, it is not necessary to provide heat exchangers with such anti-fouling openings.

Figure 4:
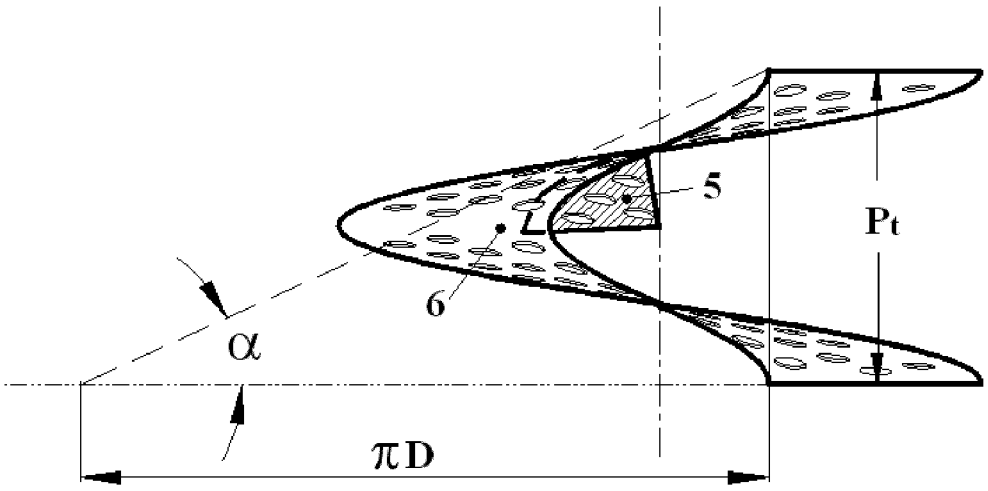
FIG. 4 is a schematic view of the helical angle of the outer helical baffle.

FIG. 4 is a schematic view of the helical angle of the outer helical baffle. The continuous doughnut shaped outer helical baffle 6 has an inner helical angle of $\alpha$ at the inner diameter, which is given by:

$$\alpha=\arctan(P_t/\pi D)$$

wherein: Pt is the pitch, and D is the diameter of the projected circle of inner helical curve of the outer helical baffle 6 onto the cross-section of the shell body. Under the given diameter of the shell body, the helical angle $\alpha$ increases with the increasing pitch, so the helical surface becomes steeper, to the effect that it is not easy to manufacture the continuous helical baffle and it is more difficult to form holes on the steep curved surface. To overcome the difficulty in manufacture, non-continuous inner helical baffles 5 can be provided in a central portion with a diameter of D, where the helical angle is relatively large, and continuous doughnut shaped outer helical baffle 6 can be provided in the portion outside this central portion, where manufacture requirements are met, so as to form a combined helical baffle structure.

Figure 5:
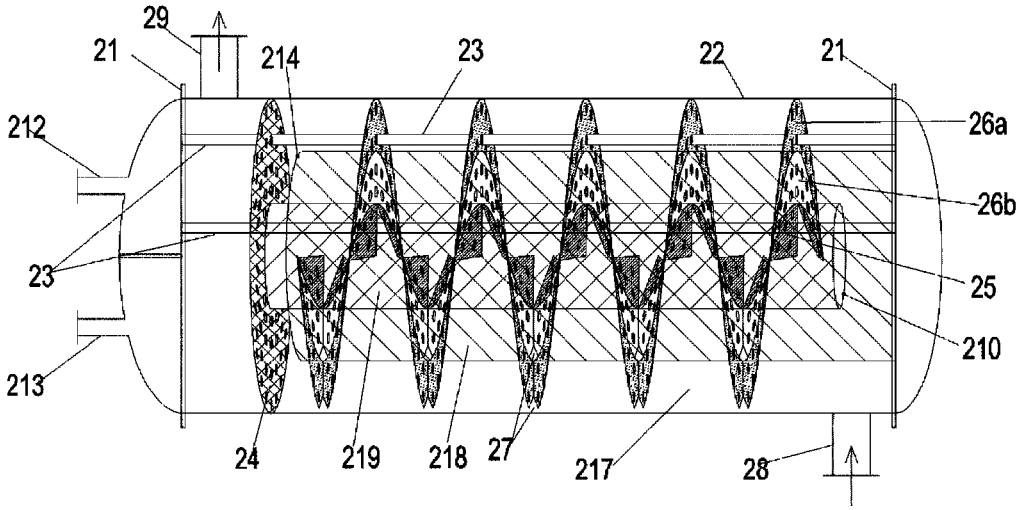
FIG. 5 is a structural diagram of a multiple shell-pass shell-and-tube heat exchanger with helical baffles according to the present invention.

FIG. 5 shows a multiple shell-pass shell-and-tube heat exchanger with helical baffles according to the present invention. As an example, the shell-and-tube heat exchanger with triple shell-pass helical baffles comprises a shell body 22, an inlet 213 for heat exchanging tube bundles, an outlet 212 for heat exchanging tube bundles, with heat exchanging tube bundles 23 penetrating through baffles and connected to two tube plates 21 on each end of the shell body 22, and a first inner sleeve tube 210 and a second inner sleeve tube 214 which separate individual shell-sides, with a separating plate 24 provided at one end of the first inner sleeve tube 210. The region between the shell body 22 and the second inner sleeve tube 214 is an outer shell-pass, the region between the first inner sleeve tube 210 and the second inner sleeve tube 214 is a middle shell-pass, and the region inside of the first inner sleeve tube 210 is an inner shell-pass. An outer shell-pass inlet tube 28 and an inner shell-pass outlet tube 29 are provided to the shell body. Complete continuous helical baffles 26 are arranged in the outer shell-pass 217 and the middle shell-pass 218, and non-continuous helical baffles 25 are arranged in the inner shell-pass 219, thus forming a multiple shell-pass shell-and-tube heat exchanger with helical baffles. At the outer helical curves of each piece of complete continuous helical baffles 26*a* in the outer shell-pass and each piece of complete continuous helical baffles 26*b* in the middle shell-pass are provided with triangular anti-fouling openings 27 for anti-fouling, that is, triangular areas are cut out at the edges of outer helical curves and are arranged at the bottoms of respective shell-side, given the heat exchanger is of a horizontal type. It can be also seen in FIG. 5 that all the helical baffles in outer shell-passes and in inner shell-pass are in the same helical surface.

Figure 6:
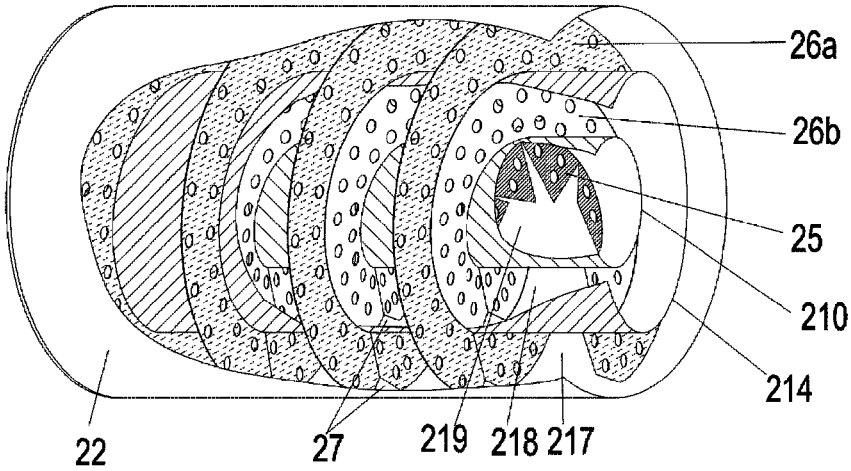
FIG. 6 is a cut-away view showing the inner structure of the multiple shell-pass shell-and-tube heat exchanger with helical baffles according to the present invention shown in FIG. 5.

FIG. 6 shows a multiple shell-pass shell-and-tube heat exchanger with helical baffles according to the present invention. In triple shell-pass shell-and-tube heat exchanger with helical baffles, as but one example, complete continuous helical baffles 26*a* and 26*b* are arranged in the outer shell-pass 217 and the middle shell-pass 218, respectively, while non-continuous helical baffles 25 are arranged in the inner shell-pass 219, thus forming a multiple shell-pass shell-and-tube heat exchanger with helical baffles. At edges of the outer helical curves of each piece of complete continuous helical baffles 26*a* and 26*b* is provided with triangular anti-fouling opening for anti-fouling, that is to say, triangular areas are cut out at the edges of outer helical curves and are arranged at the bottoms of respective shell-passes, given that the heat exchanger is of a horizontal type. The first sleeve tube is designated by 210, the second sleeve tube is designated by 214, and the shell body is designated by 22.

Figure 7:
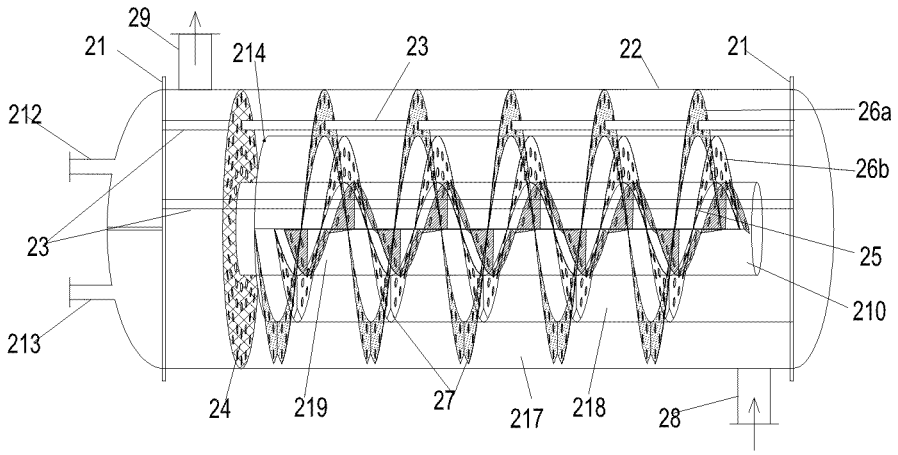
FIG. 7 is a structural diagram of another embodiment of the multiple shell-pass shell-and-tube heat exchanger with helical baffles according to the present invention.

FIG. 7 is a schematic view of another embodiment of a multiple shell-pass shell-and-tube heat exchanger with helical baffles according to the present invention. It differs from FIG. 5 and FIG. 6 in that, the helical surface 26*a* of the helical baffles in the outer shell-pass and the helical surface 26*b* of the helical baffles in the middle shell-pass are shifted with respect to each, such that they are not on the same helical surface.

Figure 8:
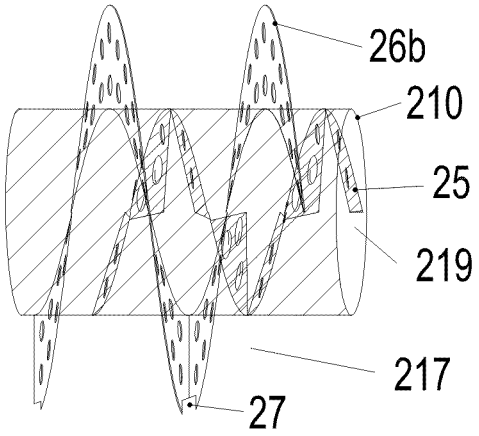
FIG. 8 is a schematic view of helical baffles of a multiple shell-pass shell-and-tube heat exchanger with helical baffles according to the present invention shown in FIG. 7.

As shown in FIG. 8, complete continuous helical baffles 26 are arranged in the outer shell-pass 217, and non-continuous helical baffles 25 are arranged in the inner shell-pass 219. At the joint of two adjacent complete continuous helical baffles 26 and next to edges of the outer helical curve, rectangular areas are cut out to form anti-fouling openings 27, and said openings are located at the bottom of the shell-side, given that the heat exchanger is of horizontal type. The first inner sleeve tube is designated by 210. In FIG. 8, the complete continuous helical baffles 26*a* in the outer shell side 217 are arranged to shift with respect to the non-continuous baffles 25 in the inner shell-pass 219, which is similar with that shown in FIG. 7.

Figure 9:
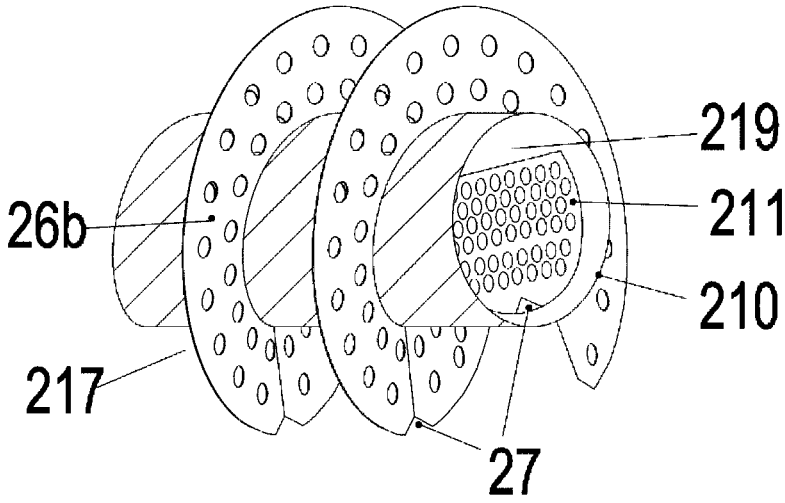
FIG. 9 is a schematic view of helical baffles and segmental baffles in a multiple shell-pass shell-and-tube heat exchanger with helical baffles according to the present invention.

As shown in FIG. 9, complete continuous helical baffles 26 are arranged in the outer shell-pass 217, and all baffles installed in the inner shell-pass 219 are segmental baffles 211. This way of implementation may simplify the manufacture process. The edges of outer helical curves of individual complete continuous helical baffles 26*b* are provided with triangular anti-fouling openings 27 for anti-fouling. The segmental baffles 211 are provided with triangular anti-fouling openings 27 for anti-fouling. The first inner sleeve tube is designated by 210.

Figure 10:
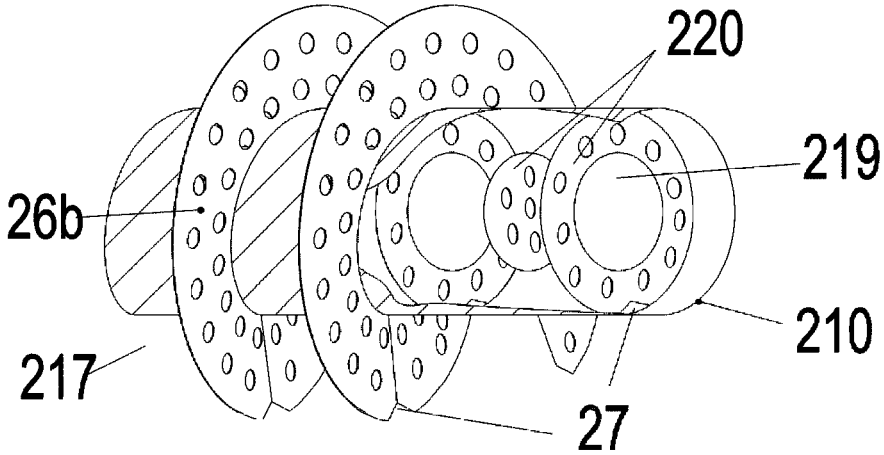
FIG. 10 is a schematic view of helical baffles and circular disk-doughnut baffles in a multiple shell-pass shell-and-tube heat exchanger with helical baffles according to the present invention.

As shown in FIG. 10, complete continuous helical baffles 26 are arranged in the outer shell-pass 217, and circular disk-doughnut baffles 220 may be installed in the inner shell-pass 219. This way of implementation may simplify the manufacture process. The edges of out helical curves of individual complete continuous helical baffles 26*b* are provided with triangular anti-fouling openings 27 for anti-fouling. The individual circular disk-doughnut baffles 220 are provided with triangular anti-fouling openings 27 for anti-fouling at its doughnut portion. The first inner sleeve tube is designated by 210.

Figure 11:
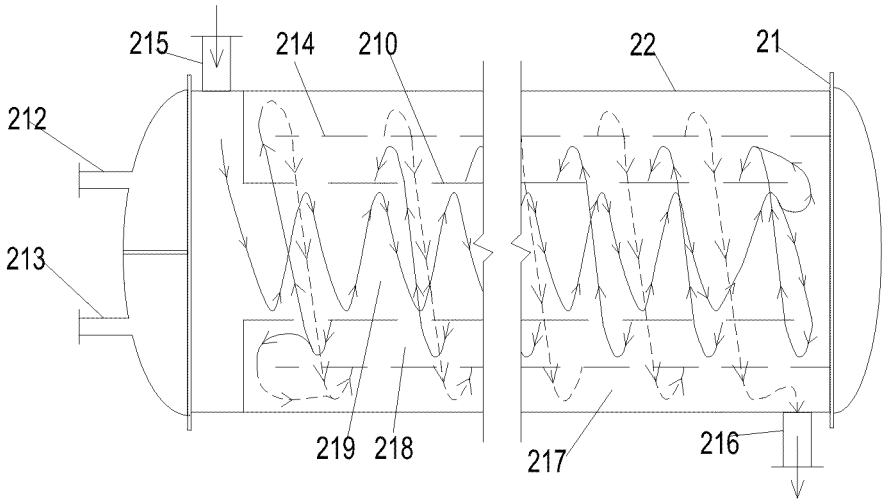
FIG. 11 is a schematic view showing the flow pattern of the fluid in the shell-sides in a multiple shell-pass shell-and-tube heat exchanger with helical baffles according to the present invention.

As shown in FIG. 11, the region between the shell body 22 and the second inner sleeve tube 214 is the outer shell-pass 217, the region between the first inner sleeve tube 210 and the second inner sleeve tube 214 is the middle shell-pass 218, and the region inside the first sleeve tube 210 is the inner shell-pass 219. An inner shell-pass inlet tube 215 and an outer shell-pass outlet tube 29 are provided to the shell body. Fluid flows through the inner shell-pass inlet 215 into the inner shell-pass 219, then into the middle shell-pass 218, into the outer shell-pass 217, and eventually flows outside the shell body 22 through the outer shell-pass outlet 216. The inlet for heat exchange tube bundles are designated by 213, the outlet for heat exchange tube bundles are designated by 212, and the tube plates are designated by 21.

Figure 12:
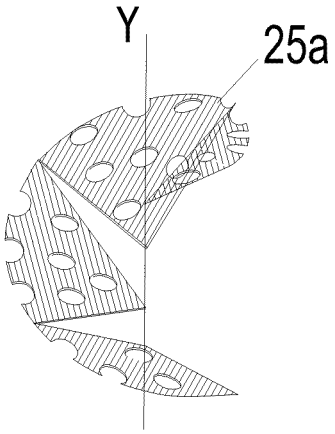
FIG. 12 is the schematic view showing a spliced non-continuous helical structure, which is an example of the configuration manner of inner helical baffles or inner shell-pass helical baffles according to the present invention.

FIG. 12 schematically shows the non-continuous joint manner of the non-continuous helical baffles in inner helical baffles 5 or inner shell-pass helical baffles 25. It can be seen that non-continuously spliced helical baffles 25*a*, which substantially take a helical form along the axis Y, are formed by splicing a plurality of fan-shaped baffles, where the spliced baffles are in form of non-continuous helical baffles 25*a*, and holes in the fan-shaped plates serve to insert heat exchange tube bundles 3 or 23 therethrough. As can be seen from the figure, the plates of the helical baffles are non-continuous. This structure enables the inner helical baffles 5 or the inner shell-pass helical baffles 25 to gently direct flows in a substantially helical fashion, and at the same time facilitates the manufacture and installation of outer helical baffles 6 or outer shell-pass helical baffles 26*a* and middle shell-pass helical baffles 26*b*.

Figure 13:
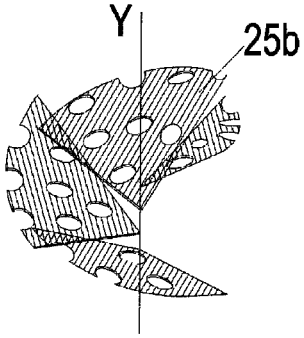
FIG. 13 is a schematic view showing a staggered joined non-continuous helical structure, which is another example of the configuration manner of inner helical baffles or inner shell-pass helical baffles according to the present invention.

As shown in FIG. 13, the non-continuous baffles, which are non-continuous helical baffles in a staggered form, are configured by inner helical baffles 5 or inner shell-pass helical baffles 25. In this example, each fan-shaped plate 25*b* are staggered with respect to each other in a way shown in FIG. 13 to form a non-continuous staggered helical structure. It behaves in a similar way as the example of FIG. 12.

Figure 14A:
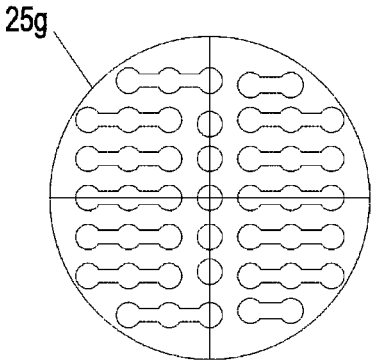
FIGS. 14*a* to 14*c* are schematic views of different forms of multi-hole circular baffles constituting the inner shell-pass baffles according to the present invention.
Figure 14B:
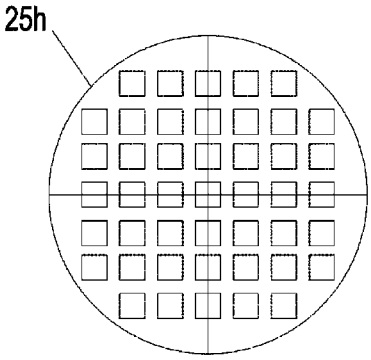
Figure 14C:
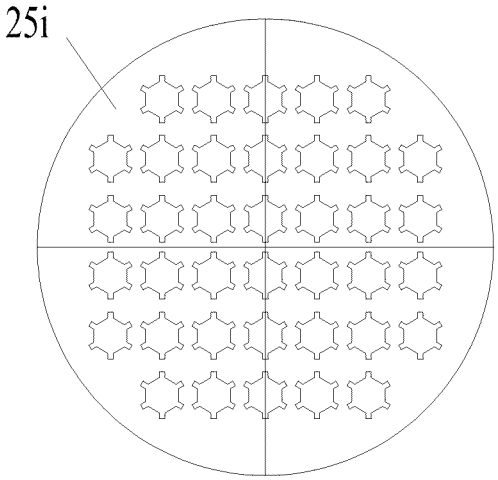

FIG. 14*a* to FIG. 14*c* are schematic views of several types of multi-hole circular baffles 25*g*, 25*h*, and 25*i* which may be formed as the inner shell-pass 219 baffles according to the present invention. These multi-hole circular baffles 25*g*, 25*h*, and 25*i* may be disposed in the inner shell-pass 219 inside of the first inner sleeve tube 210 of the present invention. It can be seen from the three views of FIG. 14*a* to FIG. 14*c* that, holes in these multi-hole circular baffles 25*g*, 25*h*, and 25*i* may have various shapes. These holes allow heat exchanging tube bundles 23 to insert therethrough, and allow fluid outside of the heat exchange tube bundles to pass through.

Figure 15:
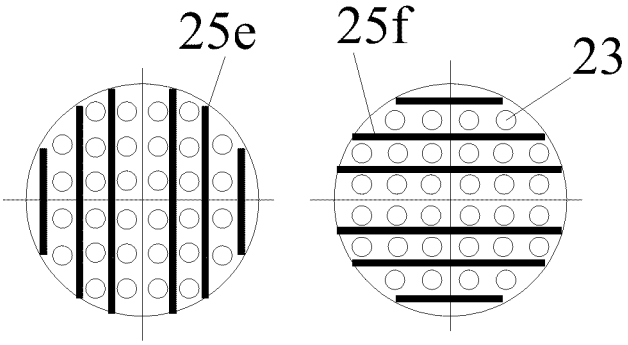
FIG. 15 is a schematic view of the baffle rods constituting the inner shell-pass baffles according to the present invention.

FIG. 15 is a schematic view of non-continuous baffle rods 25*e* and 25*f* forming the non-continuous baffles in the inner shell-pass 219 according to the invention. The circular portions between the baffle rods are the cross-section of heat exchanging tube bundles 23. Preferably, the extension directions of adjacent baffle rods 25*e* and 25*f* are arrayed in a staggered manner. As shown in the view they are arranged to be perpendicular relative to each other, which is favorable for baffling and heat exchanging.

Figure 16A:
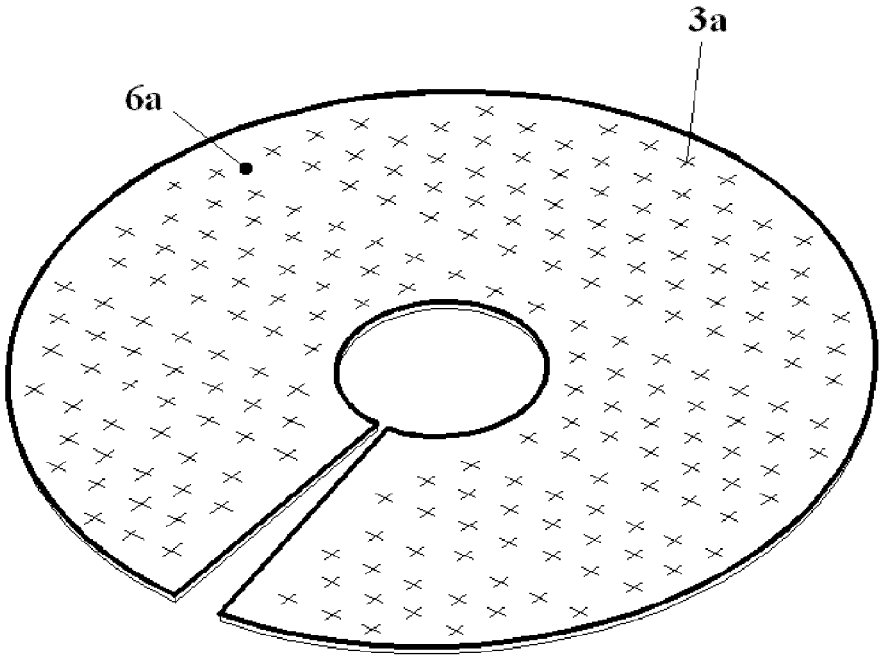
FIG. 16*a* is a schematic view of a blank outer helical baffle.
Figure 16B:
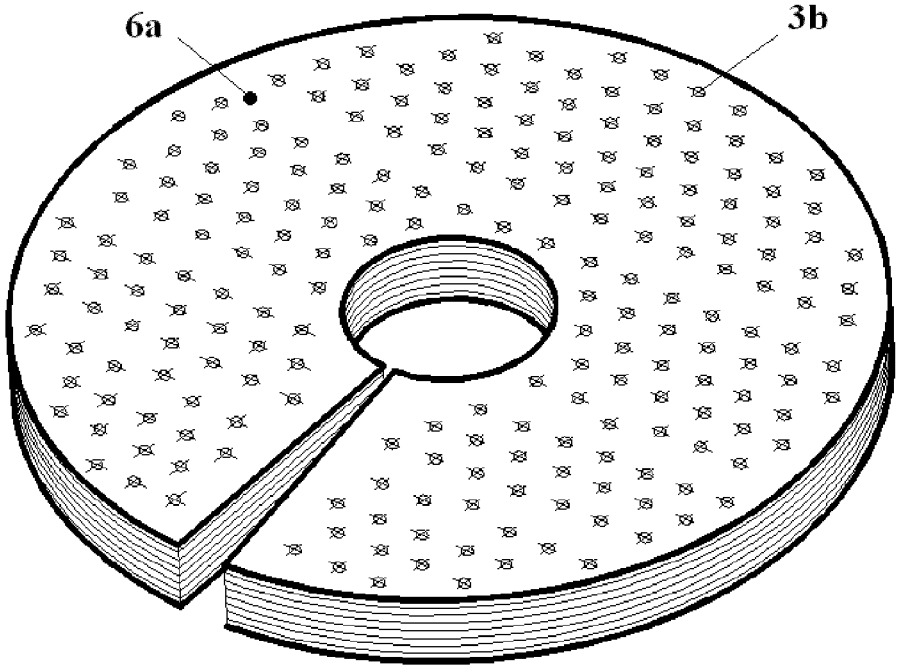
FIG. 16*b* is a schematic view that illustrates positioning centers on blank outer helical baffles.
Figure 16C:
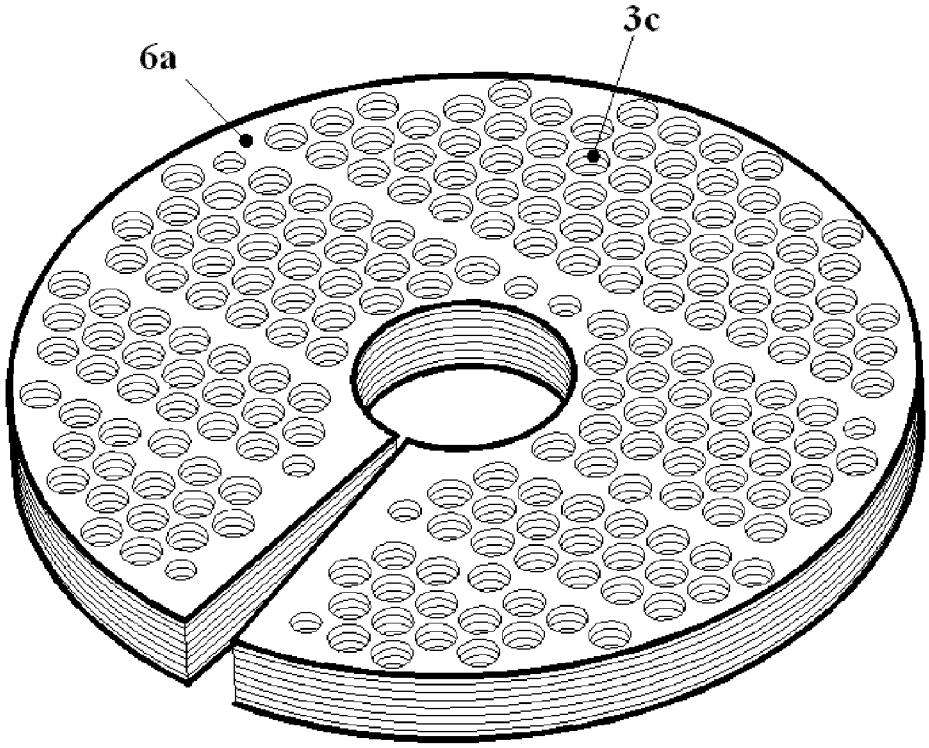
FIG. 16*c* is a schematic view that illustrates forming holes on the outer blank helical baffles directly.

FIG. 16*a*, FIG. 16*b* and FIG. 16*c* are views of blank outer helical baffles and illustrate the manufacture method for the tube bundle holes on the baffle. In FIG. 16(*a*), the flat plate 6*a* is the blank outer helical baffle 6. The central positions 3*a* of the tube bundle holes to be formed are accurately positioned beforehand.

For rigid baffle materials such as metals, the method shown in FIG. 16(*b*) may be employed, that is, first stack up a plurality of flat blank plates 6*a* of the outer helical baffles, form positioning holes 3*b* with smaller diameters than those of tube bundle holes 3*c* at each positioned center 3*a*, then stretch the plates 6*a* one by one, and stack up a plurality of plates, for example stack up on the die of drilling, the shape of which fits the helical baffles in the shell-and-tube heat exchanger, and position the tube bundle holes 3*c* according to the positions of positioning hole 3*b* and simultaneously form desired tube bundle holes 3*c* for a plurality of baffle plates. In this way, proper concentricity of the tube bundle holes on each helical baffles is ensured, and it also ensures to accurately form the shapes of the tube bundle holes in the stretched-out continuous baffles, so installation becomes more convenient.

For soft materials like plastic, tube bundle holes can be obtained directly in a way as shown in FIG. 16(*c*), where a plurality of blank plates 6*a* of the outer helical baffles are stacked up, and then circular tube bundle holes 3*c* are formed directly at individual positioned centers of tube bundle holes, then the plates 6*a* are stretched to form the desired outer helical baffles 6. As tube bundle holes may deform as result of stretching soft materials, the tube bundle holes that do not match diameters of heat exchanging tubes may be reconfigured to achieve desired shapes.

What is claimed is:

1. A multiple shell pass shell-and-tube heat exchanger with helical baffles, comprising a shell body, an inlet for heat exchange tube bundles and an outlet for heat exchange tube bundles arranged at ends of the shell body, heat exchange tube bundles penetrating through the helical baffles and connected to two tube plates on each end of the shell body, wherein a first inner sleeve tube coaxially arranged in the shell body, a second inner sleeve tube arranged outside the first inner sleeve tube, an end of the second inner sleeve tube connected to one of the two tube plates, the first inner sleeve tube provided with a separating plate at an opposite end to an end at which the second inner sleeve tube is connected to said one of the two tube plates, whereby there forms an outer shell-pass between the shell body and the second inner sleeve tube, a middle shell-pass between the first inner sleeve tube and the second inner sleeve tube, as well as an inner shell-pass in an entire inside of the first inner sleeve tube; an outer shell-pass inlet tube and an inner shell-pass outlet tube provided to the shell body, whereby there forms a shell-pass flow passage outside said tube bundles, thus a multiple shell-pass is formed, wherein baffles in shell-passes other than the inner shell-pass are formed by splicing a plurality of helical baffles in such a transition manner that plate surfaces of individual baffles are continuous to each other along a helical direction, so baffles in shell-passes other than the inner shell-pass form a plurality of helical cycles and take the form of helical baffles with the plate surfaces thereof completely continuous so as to form complete continuous helical baffles, while the inner shell-pass is provided with a plurality of non-continuous baffles, wherein, said non-continuous baffles are in the form of non-continuously staggered fan-shaped helical baffles, which take a substantially helical form along a longitudinal axis of the heat exchanger, and are formed by staggering and at least partially overlapping a plurality of fan-shaped plates, the fan-shaped plates having holes serving to receive a heat exchange tube bundle therethrough.

2. A multiple shell pass shell-and-tube heat exchanger with helical baffles according to claim 1, wherein, main bodies of said baffles in shell-sides other than the inner shell-pass are formed by splicing a plurality of one-piece helical curved plate units together with each other, each of which constitutes a helical cycle.

3. A multiple shell pass shell-and-tube heat exchanger with helical baffles according to claim 1, wherein, a heat exchanger of multiple shell-passes is formed when there are a first inner sleeve tube and a second inner sleeve tube or a plurality inner sleeve tubes.

4. A multiple shell pass shell-and-tube heat exchanger with helical baffles according to claim 1, wherein, flow directions in said outer shell-pass inlet tube and said inner shell-pass outlet tube can be swapped, thus respectively becoming an outer shell-pass outlet tube and an inner shell-pass inlet tube accordingly.

5. A multiple shell pass shell-and-tube heat exchanger with helical baffles according to claim 1, wherein, said continuous helical baffles in the outer shell-passes and said non-continuous helical baffles in the inner shell-pass are in a form of single helix or multi-helix, with the helical direction thereof being left-handed or right-handed.

6. A multiple shell pass shell-and-tube heat exchanger with helical baffles according to claim 1, wherein, when said heat exchanger is formed as a horizontal type, outer helical edges of said helical baffles in shell-passes other than the inner shell-pass are provided with anti-fouling openings at the positions closest to the ground.

* * * * *